US008713828B2

(12) United States Patent
Striegel

(10) Patent No.: US 8,713,828 B2
(45) Date of Patent: May 6, 2014

(54) VENDING MACHINE-RELATED LABEL APPARATUS AND METHOD

(75) Inventor: Diane M. Striegel, Boonton, NJ (US)

(73) Assignee: Intercontinental Great Brands LLC, East Hanover, NJ (US)

( * ) Notice: Subject to any disclaimer, the term of this patent is extended or adjusted under 35 U.S.C. 154(b) by 579 days.

(21) Appl. No.: 12/604,479

(22) Filed: Oct. 23, 2009

(65) Prior Publication Data

US 2011/0094851 A1 Apr. 28, 2011

(51) Int. Cl.

| | |
|---|---|
| ***G09F 15/00*** | (2006.01) |
| ***G09F 1/04*** | (2006.01) |
| ***G09F 23/06*** | (2006.01) |

(52) U.S. Cl.

CPC ..... *G09F 1/04* (2013.01); *G09F 23/065* (2013.01)

USPC ..... 40/606.04; 312/234.4

(58) Field of Classification Search

USPC ..... 40/306, 606.04, 661.03; 211/183, 211/90.01, 134, 153; 312/234, 234.4, 126, 312/128

See application file for complete search history.

(56) References Cited

U.S. PATENT DOCUMENTS

| | | | | |
|---|---|---|---|---|
| 855,767 | A * | 6/1907 | Gibson | 312/234.3 |
| 1,186,031 | A | 6/1916 | Patterson et al. | |
| 1,247,665 | A | 11/1917 | Giles | |
| 1,291,749 | A | 1/1919 | Brandt | |
| 1,592,497 | A * | 7/1926 | Mays | 312/279 |
| 1,715,237 | A * | 5/1929 | Huston | 40/661.08 |
| 1,845,919 | A | 2/1932 | Jones | |
| 2,444,747 | A | 7/1948 | Niewoehner | |
| 3,269,595 | A * | 8/1966 | Krakauer et al. | 221/75 |
| 3,824,720 | A * | 7/1974 | Langwell | 40/661.08 |
| 3,901,366 | A | 8/1975 | Schuller et al. | |
| 3,993,215 | A | 11/1976 | Cox et al. | |
| 4,354,613 | A | 10/1982 | Desai et al. | |
| 4,713,899 | A * | 12/1987 | Fast | 40/661.08 |
| 4,735,290 | A | 4/1988 | Byrley | |
| 5,429,430 | A * | 7/1995 | Johnson | 312/128 |
| 5,690,251 | A | 11/1997 | Wade | |
| 5,724,757 | A * | 3/1998 | Warden | 40/360 |
| 2002/0124941 | A1 * | 9/2002 | Valiulis | 156/227 |
| 2006/0102645 | A1 | 5/2006 | Walker et al. | |
| 2007/0089339 | A1 | 4/2007 | Vidondo | |
| 2009/0019744 | A1 | 1/2009 | Myatt et al. | |

FOREIGN PATENT DOCUMENTS

| | | |
|---|---|---|
| EP | 0 258 954 | 3/1988 |
| EP | 0 572 119 | 12/1993 |
| GB | 1004516 | 9/1965 |
| JP | 6068347 | 3/1994 |
| WO | WO 99/50801 | 10/1999 |
| WO | WO 03/072471 | 9/2003 |

* cited by examiner

*Primary Examiner* — Joanne Silbermann

(74) *Attorney, Agent, or Firm* — Fitch, Even, Tabin & Flannery LLP

(57) ABSTRACT

A label (200) is configured to be disposed in an installed position on a vending machine (100) vendable-product support shelf (104). This label has a horizontally-oriented first portion (201) and a vertically-oriented second portion (202). The horizontally-oriented first portion can be oriented directly beneath an area that vertically corresponds to a given row of vendable products (106). This first portion has first promotional content (203) (comprising, for example, graphic content such as alphanumeric material and/or images) that is visible to a consumer viewing the interior of the vending machine through the transparent front portion (at least when the given row of vendable products is empty). The second portion can similarly have second promotional content (204) (again comprising, for example, graphic content such as alphanumeric material and/or images) that is visible to the aforementioned consumer regardless of whether the given row of vendable products is empty.

14 Claims, 4 Drawing Sheets

VENDING MACHINE-RELATED LABEL APPARATUS AND METHOD

TECHNICAL FIELD

This invention relates generally to vending machines and more particularly to the provision of graphic content in a vending machine application setting.

BACKGROUND

Vending machines are well known in the art. The basic precepts of providing a machine that accepts monetary consideration and automatically provides, in exchange, a corresponding product appears to date back to the first century. Something quite akin to the modern vending machine began appearing in the 1880's. By one well-known approach, the vending machine comprises a housing having a front portion that is at least partially transparent to thereby permit a consumer to view the available inventory of vendable products. In many such cases, the interior of the vending machine includes one or more shelves to support these vendable products.

Though of long-standing practice, vending machines are not without their problems. As one example, the restocking of such a vending machine can be inconsistent with a planned approach in these regards. In particular, the restocking attendant may place particular vendable products in an incorrect location within the vending machine. As a related problem, such an attendant may fail to stock a particular vendable product in the vending machine at all. Such problems can lead to reduced sales, frustrated marketing and promotional activities, and so forth.

As another example in these regards, not all locations within such a vending machine are considered of equal promotional value. Typically, the vendable-product support shelves that are closer to eye level for the typical anticipated consumer are considered better than shelves disposed lower within the vending machine.

BRIEF DESCRIPTION OF THE DRAWINGS

The above needs are at least partially met through provision of the vending machine-related label apparatus and method described in the following detailed description, particularly when studied in conjunction with the drawings, wherein.

Figure 1:
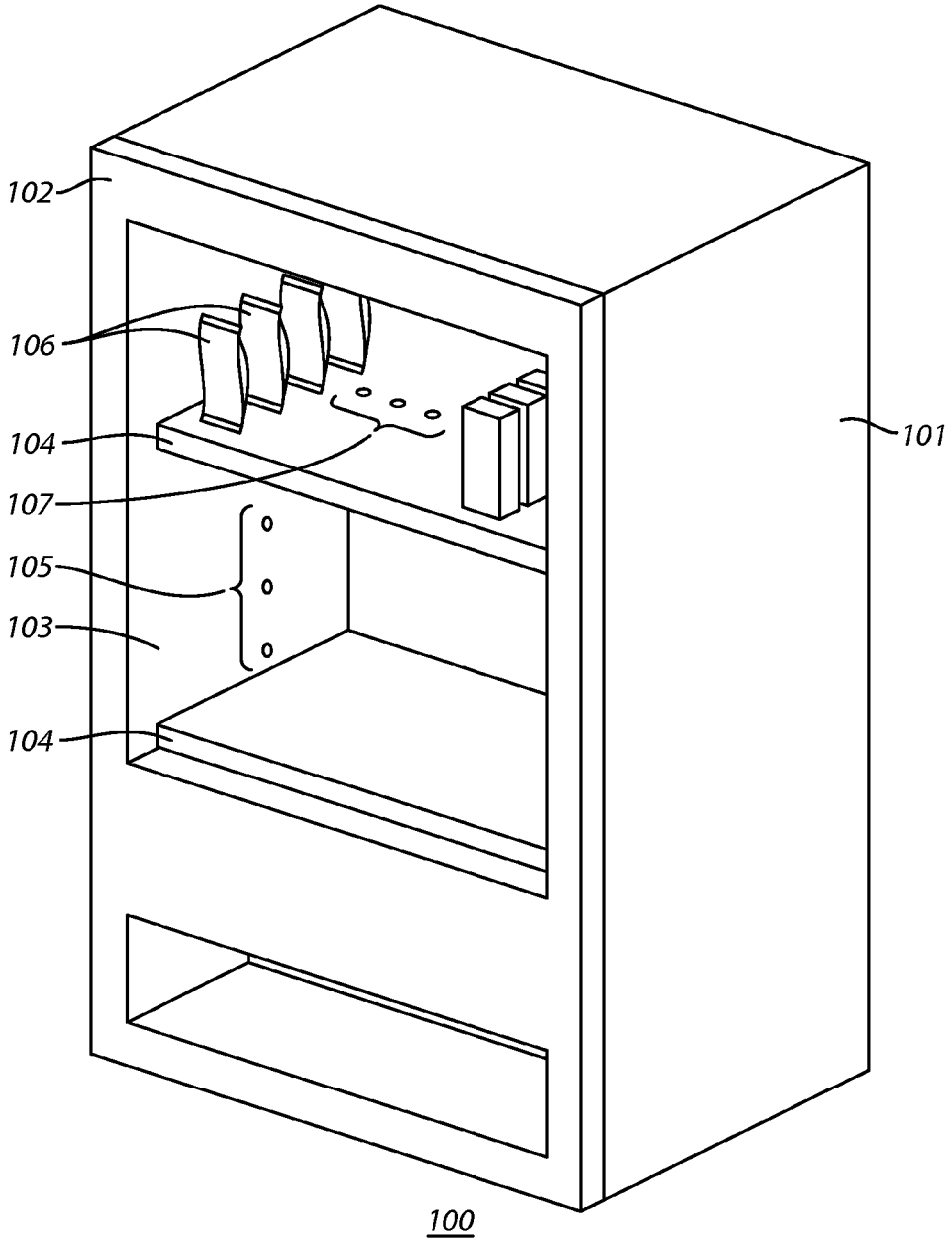
FIG. 1 Prior Art
FIG. 1 comprises a perspective schematic view as configured in accordance with the prior art.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, these various embodiments are suitable to employ in conjunction with a vending machine that comprises a housing having a front portion (wherein at least a portion of that front portion is transparent) and one or more vendable-product support shelves oriented within the housing such that vendable products oriented in conjunction with that shelf are visible to a consumer through the transparent portion of the front of the vending machine. Still speaking generally, these teachings contemplate a label that is configured to be disposed in an installed position on such a vendable-product support shelf. This label, when in such an installed position, comprises a horizontally-oriented first portion and a vertically-oriented second portion.

By one approach, the horizontally-oriented first portion is oriented directly beneath an area that vertically corresponds to a given row of vendable products that are oriented proximally above the vendable-product support shelf. This first portion has first promotional content (comprising, for example, graphic content such as alphanumeric material and/or images) that is visible to a consumer viewing the interior of the vending machine through the transparent front portion (at least when the given row of vendable products is empty) and in many cases can also be at least partially viewed, at least from certain viewing angles, in between stocked vendable products.

Also by one approach, the vertically-oriented second portion has side edges that are at least substantially co-extensive with the side edges of the aforementioned horizontally-oriented first portion. This second portion has second promotional content (again comprising, for example, graphic content such as alphanumeric material and/or non-alphanumeric images) that is visible to the aforementioned consumer regardless of whether the given row of vendable products is empty.

These teachings will readily accommodate forming this label using cardstock material. By one approach, an adhesive can be applied to the backside of the label to facilitate retaining the label in place on the shelf.

By one approach, a given shelf, which typically supports a plurality of rows of differing vendable products, can be provided with a corresponding plurality of such labels. These labels can have differing widths as appropriate to accommodate the differing widths of the vendable products themselves.

Those skilled in the art will appreciate that a variety of benefits accrue through the employment of these teachings. When the first promotional content (as appears on the horizontally-oriented first portion of the label) serves to identify a particular vendable product, for example, the label serves as a ready guide and obvious instruction to a person restocking the vending machine regarding which vendable product to place in that particular row. This, in turn, can help to ensure that stocking and display strategies are supported by field personnel.

When a restocker fails to properly place vendable products within a given vending machine, these teachings also make it simple to visually ascertain such mismatches. This is because the restocker themselves or a supervisor or auditor can typically readily view at least portions of the first promotional content around, through, and between the displayed vendable products and this, in turn, facilitates making a on-the-spot comparison to detect inconsistencies in these regards.

Because the viewer's ability to view the content of the first promotional content on the shelf typically improves as the viewer's point of view becomes higher with respect to the shelf, these teachings also uniquely provide the opportunity to increase the promotional wherewithal of lower-placed shelves in a vending machine. This, in turn, can increase the promotional worth of lower-placed shelves.

These and other benefits may become clearer upon making a thorough review and study of the following detailed description. Referring now to FIG. 1, it may be helpful to briefly describe a typical vending machine application setting in which these teachings can be applied. Those skilled in the art will recognize and understand that the specifics of this example serve an illustrative purpose only and are not offered with any suggestion or intent that these specifics comprise an exhaustive listing of all such possibilities in this regard.

Such a vending machine 100 typically comprises a housing 101 that has a front portion 102. This front portion 102 often comprises a door that can be unlocked and pivoted in order to provide restocking and maintenance access to the interior of the housing 101. In any event, at least a portion 103 of this front portion 102 is transparent. This transparent portion 103 can be comprised of glass, clear plastic, or the like. As used herein, this reference to "transparent" will be understood to refer to a range of transparency ranging from utterly clear and free of distortion to at least sufficiently clear enough to permit a viewer to view the contents of the vending machine 100.

Such a vending machine 100 has at least one vendable-product support shelf 104. In this illustrative example the vending machine 100 has a plurality of such vendable-product support shelves 104 as represented by the ellipses denoted by reference numeral 105. These shelves 104 often span, more or less, the interior width of the vending machine housing 101 and serve to support one or more rows of vendable products 106. Generally speaking, such a shelf 104 will support a plurality of such rows as represented by the ellipses denoted by reference numeral 107. These vendable products can assume various form factors and packaging types including but not limited to bags, boxes, cans, canisters, and so forth.

This reference to "support" will be understood by those skilled in the art to refer to a range of bearing functionality. In some cases the shelf serves to completely bear, in and of itself, the entire weight of the vendable product while retaining the vendable product in inventory and during at least part of the vending process. In other cases, part or all of the weight of the vendable product is borne by an additional component such as, for example, a helical component that serves to at least partially support the vendable product during part or all of the storage/presentation stage and/or during part or all of the vending stage (see, for example, the helical component shown in FIG. 4 and denoted by reference numeral 401). In such a case, the support shelf may be located directly beneath the helical component such that the support offered by the shelf may be, at least at times, virtual rather than actual.

Those skilled in the art will recognize that a modern vending machine includes numerous other components. As these additional elements comprise a well-understood area of endeavor and further as these teachings are not particularly sensitive in these regards, for the sake of clarity and brevity details in these regards are not provided here.

Figure 2:
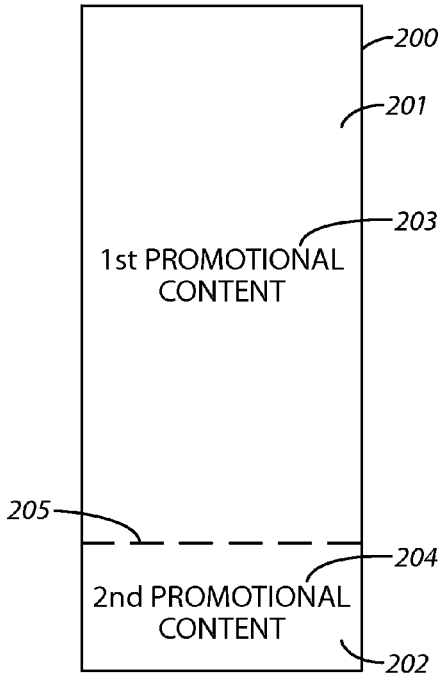
FIG. 2 comprises a top plan view as configured in accordance with various embodiments of the invention.
Figure 3:
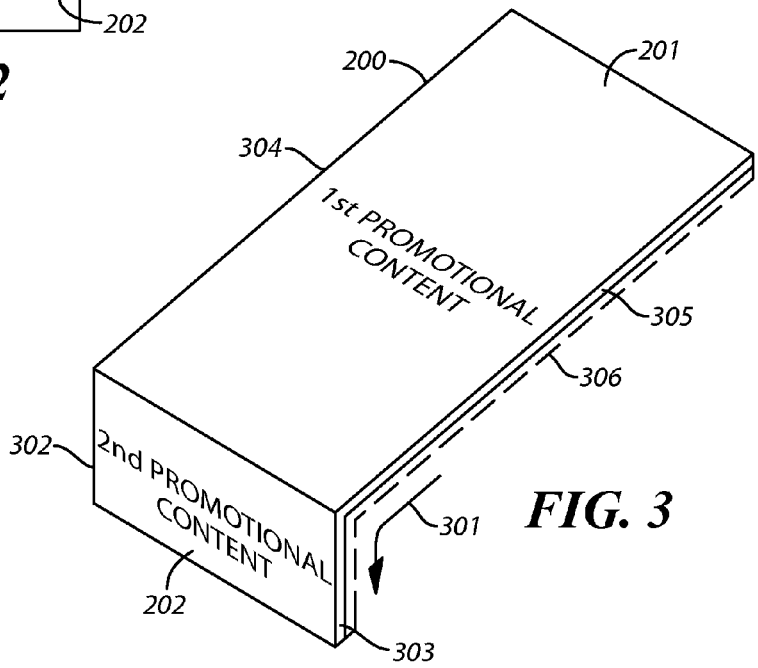
FIG. 3 comprises a perspective view as configured in accordance with various embodiments of the invention.

Referring now to FIGS. 2 and 3, these teachings provide a label 200 that is configured to be disposed on such a vendable-product support shelf 104. This label 200 can be comprised of, for example, cardstock (i.e., a paper-based material such as paper of various plies, cardboard, and the like), one or more layers of thin plastic material, a thin metal or foil, or any other suitable carrier.

This label 200 comprises a first portion 201 and a second portion 202. In use, the first portion 201 will typically be disposed horizontally while the second portion 202 is vertically disposed. More particularly, in a typical application setting the second portion 202 will often be folded downwardly with respect to the first portion 201 (as represented here by the arrow denoted by reference numeral 301). In many cases, so folded, the second portion 202 will be at an approximate 90 degree angle with respect to the first portion 201. As will be shown below, such a configuration can be particularly useful in conjunction with a support shelf 104 having a front edge that is, itself, at a 90 degree angle to the horizontal upper surface of that shelf.

Such a label 200 can have whatever width may be suitable in a given application setting. More will be said about this further below. For the moment, however, it may be useful to note that, by one approach, the side edges 302 and 303 of the second portion 202 can be fully or at least virtually co-extensive with the side edges 304 and 305 of the first portion 201 of the label 200. This can be helpful to avoid confusion with respect to any informational content borne by the first portion 201 or the second portion 202 and/or the vendable products in conjunction with which the labels 200 are placed and displayed.

By one approach, such a label 200 can have an adhesive material 306 disposed on the backside thereof. This adhesive material 306 can be evenly disposed over the entire backside if desired, or only on selected sub-portions thereof. It might also be appropriate in a given application setting to only place this adhesive 306, for example, on portions of the backside that are opposite the first portion 201 (or that are opposite the second portion 202, as desired). The adhesive 306 can comprise a permanent adhesive that is intended to hold the label 200 in an installed position unless or until the label 200 is to be removed using a removal process that destroys the label 200. Or, if desired, this adhesive 306 can comprise a less aggressive adhesive that will permit the label 200 to be non-destructively removed and possibly reused. Such adhesives and their corresponding manner of application and use are well known in the art and require no further elaboration here.

The aforementioned first portion 201 has first promotional content 203 displayed thereon. By one approach this first promotional content 203 comprises, at least in part, informational content that identifies a given vendable product that is to be placed for sale in a row of vendable products that will be oriented in vertical proximity to the label 200 when installed in a given vending machine. This information content can comprise, for example, alphanumeric content and/or one or more non-alphanumeric images. Examples include, but are not limited to, product names, manufacturer's and/or distributor's trademarks and/or trade dress, logos, slogans, photos and/or other portrayals of the product itself and/or it's ordinary retail-level packaging, nutritional information, instructions regarding use or enjoyment, sweepstakes availability and information, and so forth. This informational content can be monochromatic, full color, or anything in between.

By one approach, this first promotional content 203 can be displayed only, for example, on a part of the first portion 201 that is proximal to the second portion 202. This will have the effect of placing this first promotional content 203 towards the front of the shelf when the label 200 has been correctly installed. By another approach, and as another example, this first promotional content 203 can make use of the entire, or essentially the entire, first portion 201 of the label 200.

The aforementioned second portion 202 can itself comprise displayed second promotional content 204. This second promotional content 204 can comprise content similar or substantively identical to the first promotional content 203 if desired. In many application settings it may be useful if this second promotional content 204 further, or exclusively, comprise vending-selection information, pricing information, or the like. "Vending-selection information" will be understood to refer to information that a consumer employs to make their vendable-product selection. In many cases this comprises a code that the consumer enters on a selection keypad or the like. "Pricing information," in turn, will be understood to refer to information regarding the required purchase price for the particular vendable products with which the label 200 is associated.

As noted earlier, by one approach, the label 200 is configured to have a second portion 202 that is folded with respect to a first portion 201. If desired, to facilitate making this fold a fold line 205 can also be displayed on the label 200. By one approach, and again if desired, this fold line 205 can comprise a scored line comprising an indentation or notch to facilitate the making of this fold in the correct location. The forming of score lines of course comprises a well-known activity and requires no further description here.

Figure 4:
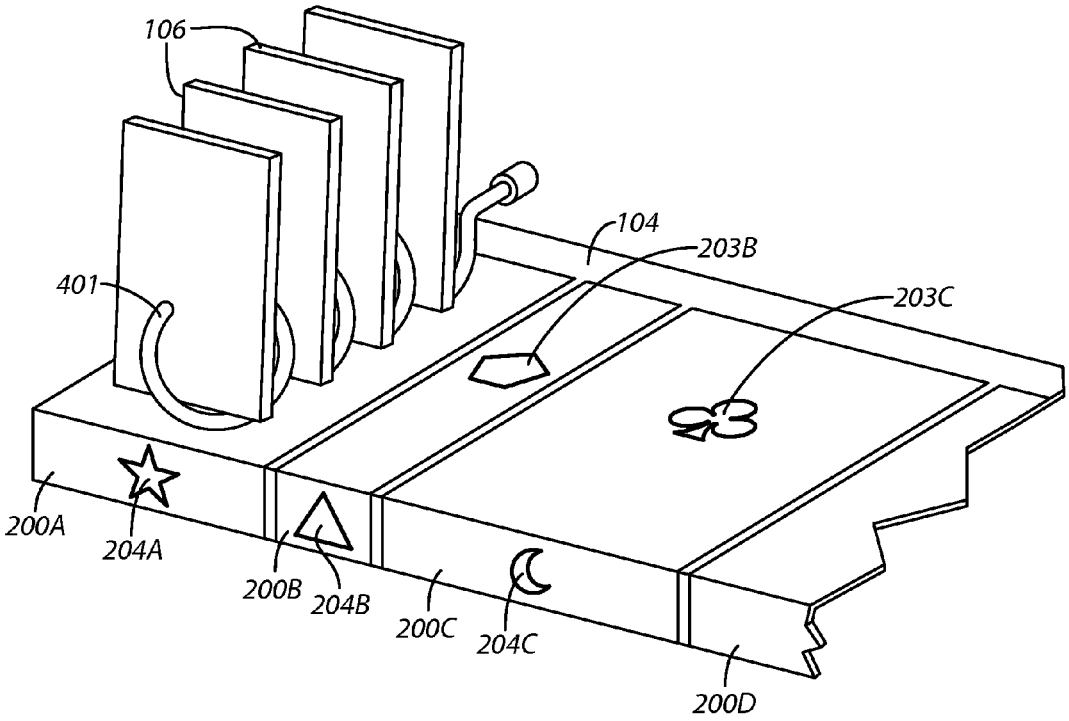
FIG. 4 comprises a perspective cutaway detail view as configured in accordance with various embodiments of the invention.

Referring now to FIG. 4, such a label 200 can be readily placed on a vendable-products support shelf 104. As noted earlier, there can be one such label for each of a plurality of rows of products as are each vertically, though proximally, disposed above and supported by this shelf 104. In this illustrative partial view of such a shelf 104, four such labels 200A, 200B, 200C, and 200D are shown. Those skilled in the art will appreciate that the number of such labels provided in a given application setting can and will vary with the number of vendable-product rows that are supported by a given shelf.

This example also illustrates that the width of each label can vary. In particular, this width can vary to accommodate the lateral girth of the vendable product with which the label corresponds. For example, the label denoted by reference numeral 200A is wider than the label denoted by reference numeral 200B but narrower than the label denoted by reference numeral 200C.

This example also serves to illustrate that the first promotional content can similarly vary from label to label to again match differences between the corresponding vendable products. Such differences are schematically represented here, for example, where one of the labels 200B has a pentagram as its first promotional content 203B while an adjacent label 200C has a club as its first promotional content 203C. Similarly differences are schematically represented for the second promotional content, where a first label 200A has a star representing its second promotional content 204A, a second label 200B has a triangle representing its second promotional content 204B, and the third label 200C has a crescent moon representing its second promotional content 204C.

So configured, and when properly installed in such a position, the second portion 202 of each label is vertically oriented on the front edge of the shelf 104 and is, in this example, vertically co-extensive with that front edge. In this example, then, the second promotional content 204 is ready visible to a potential consumer viewing the contents of the vending machine through the aforementioned transparent front portion. It will be noted and appreciated that this visibility persists regardless of whether the given corresponding row of vendable products is fully stocked, partially depleted, or empty. Accordingly, the second promotional content 204 remains available to the consumer under essentially all conditions and can therefore aid and assist with their vetting and selection activities.

The second portion 201 of the label 200 can, if desired, be co-extensive with the depth of the shelf 104. Or, and as shown, the second portion 201 can have a shorter length. In some cases, it might also be useful to have the second portion 201 extend beyond the back edge of the shelf 104.

So configured, and at the least, the first promotional content 203 which appears on the first portion 201 of the label 200 is visible when the given row of vendable products is empty. This, in turn, then serves as an obvious, clear, and potent instruction to a person restocking the vending machine regarding what vendable product to stock in that particular row. This can therefore contribute greatly to ensuring that vending machines are consistently stocked in a strategically appropriate manner.

It will also be appreciated that, under at least some viewing conditions and depending to some extent upon the form factor of the corresponding vendable product and the stocking density, this first promotional content 203 can also be viewed by the consumer even when the corresponding row is partially or even fully stocked with the vendable product. This can occur because the width of the label 200 can exceed the width of the vendable product itself. This can also occur because, particularly when looking somewhat down on the shelf and hence the label (as when the shelf is one of the lower-positioned shelves in a given vending machine), there are spaces between vendable products in a same row through which the first promotional content 203 can be at least partially viewed.

Figure 5:
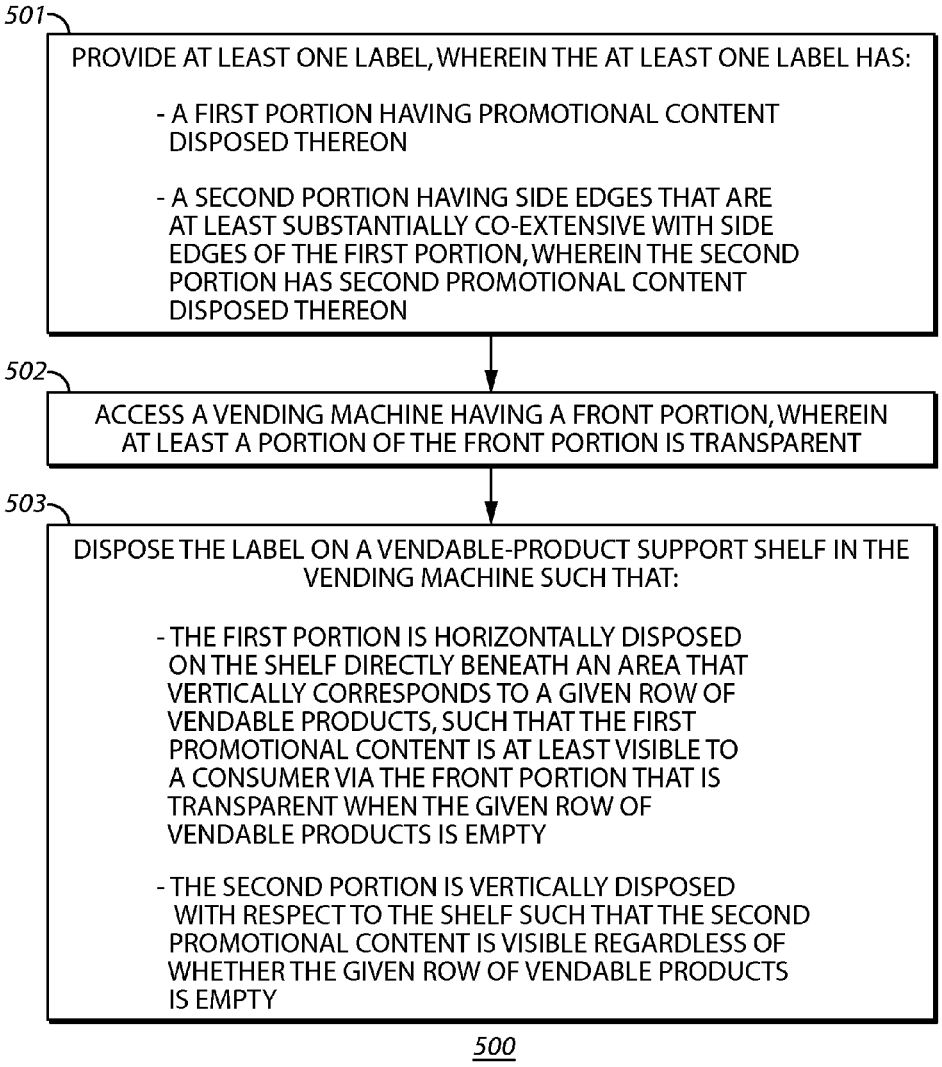
FIG. 5 comprises a flow diagram as configured in accordance with various embodiments of the invention.

An illustrative process that is compatible with many of these teachings will now be presented. Referring to FIG. 5, such a process 500 can comprise the step 501 of providing one or more labels such as the label described above. Step 502 then provides for accessing a vending machine having a front portion that is at least partially transparent such that the contents of the vending machine are at least partially visible to a consumer.

Pursuant to step 503, one then disposes the provided label(s) on one or more of the vendable-product support shelves as are contained in this vending machine. In particular, the labels are installed such that the aforementioned first portion is horizontally disposed on the shelf directly beneath an area that vertically corresponds to a given row of vendable products. When properly installed in this manner, the promotional content appearing on that first portion is at least visible when that given row of vendable products is empty. This step 503 also comprises installing the label such the aforementioned second portion is vertically disposed with respect to the shelf such that the second promotional content is vertically positioned and hence visible regardless of whether that row of vendable products is empty or not.

Those skilled in the art will recognize and appreciate that these teachings are inexpensive to implement and can be readily used with a wide variety of already-fielded vending machines without any physical alterations being required to ensure compatible use. It is therefore understood that these teachings serve to greatly leverage the existing capabilities and functionality of such platforms. It will further be observed and appreciated that these teachings are highly scalable and can be successfully employed with a wide variety of differing vending machine application settings. By both helping to ensure that a given vending machine is properly stocked and increasing the promotional value of shelf locations that have, heretofore, been considered less promotionally successfully, these teachings comprise an inexpensive and easily-implemented approach to improving vending machine performance in a wide variety of application settings.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept. As but one example in this regard, if desired, these teachings will accommodate directly printing such a label on such a shelf. As but another example in these regards, these teachings will readily accommodate having the first promotional content and the second promotional content be intermingled such that each comprises a portion of a shared message, image, or the like.

I claim:

1. A vending machine apparatus comprising:

a housing having a front portion, wherein at least a portion of the front portion is transparent;

at least one vendable-product support shelf disposed within the housing such that vendable products disposed in conjunction with the vendable-product support shelf are visible to a consumer through the portion of the housing front portion that is transparent;

at least one label disposed on the vendable-product support shelf, wherein the at least one label has:

a horizontally-oriented first portion that is disposed directly beneath an area that vertically corresponds to a given row of vendable products that are disposed proximally above the vendable-product support shelf, wherein the first portion has first promotional content that is at least visible when the given row of vendable products is empty;

a vertically-oriented second portion having side edges that are at least substantially co-extensive with side edges of the horizontally-oriented first portion, wherein the second portion has second promotional content that is visible regardless of whether the given row of vendable products is empty.

2. The vending machine apparatus of claim 1 wherein the at least one label comprises a plurality of such labels disposed on the vendable-product support shelf.

3. The vending machine apparatus of claim 2 wherein there is one such label disposed beneath each row of vendable products that are disposed proximally above the vendable-product support shelf.

4. The vending machine apparatus of claim 1 wherein the vertically-oriented second portion of the label is at least vertically co-extensive with a front edge of the vendable-product support shelf.

5. The vending machine apparatus of claim 1 wherein the label comprises cardstock.

6. The vending machine apparatus of claim 1 wherein the label adheres to the vendable-product support shelf via an adhesive.

7. The vending machine apparatus of claim 1 wherein the first promotional content comprises, at least in part, informational content to identify the vendable product that is to be placed for sale in the given row of vendable products that are oriented in vertical proximity to the label.

8. The vending machine apparatus of claim 1 wherein the second promotional content comprises, at least in part, at least one of vending-selection information and pricing information.

9. A method for use with a vending machine, comprising:

providing at least one label, wherein the at least one label has:

a first portion having promotional content disposed thereon;

a second portion having side edges that are at least substantially co-extensive with side edges of first portion, wherein the second portion has second promotional content disposed thereon;

accessing a vending machine having a front portion, wherein at least a portion of the front portion is transparent;

disposing the at least one label on a vendable-product support shelf in the vending machine such that:

the first portion is horizontally disposed on the vendable-product support shelf directly beneath an area that vertically corresponds to a given row of vendable products, such that the first promotional content is at least visible to a consumer via the front portion that is transparent when the given row of vendable products is empty;

the second portion is vertically disposed with respect to the vendable-product support shelf such that the second promotional content is visible regardless of whether the given row of vendable products is empty.

10. The method of claim 9 wherein disposing the at least one label on a vendable-product support shelf comprises disposing a plurality of such labels on the vendable-product support shelf.

11. The method of claim 10 wherein the first promotional content varies amongst the plurality of such labels in order to correspond to different vendable products.

12. The method of claim 9 wherein disposing the at least one label on a vendable-product support shelf comprises adhering the at least one label on the vendable-product support shelf.

13. The method of claim 9 wherein disposing the at least one label on a vendable-product support shelf in the vending machine such that the second portion is vertically disposed with respect to the vendable-product support shelf comprises folding the second portion downwardly with respect to the first portion.

14. The method of claim 13 wherein folding the second portion downwardly with respect to the first portion comprises folding the second portion approximately 90 degrees with respect to the first portion.

* * * * *